US006170452B1

(12) United States Patent
Wisinski

(10) Patent No.: US 6,170,452 B1
(45) Date of Patent: Jan. 9, 2001

(54) METHOD AND APPARATUS FOR OPERATING A LOCOMOTIVE ENGINE

(75) Inventor: Jeffrey D. Wisinski, Erie, PA (US)

(73) Assignee: General Electric Company, Schenectady, NY (US)

( * ) Notice: Under 35 U.S.C. 154(b), the term of this patent shall be extended for 0 days.

(21) Appl. No.: 09/413,929

(22) Filed: Oct. 7, 1999

(51) Int. Cl.[7] ..... F02N 15/10; F01M 11/10
(52) U.S. Cl. ..... 123/179.4; 123/196 S
(58) Field of Search ..... 123/196 S, 198 D, 123/41.15, 196 AB, 179.4, 179.3; 84/6.4; 701/113

(56) References Cited

U.S. PATENT DOCUMENTS 4,413,595 * 11/1983 Potts, Jr. ..... 123/142.5 R
4,592,323 6/1986 Vest .
4,847,768 * 7/1989 Schwartz et al. ..... 701/30
5,072,703 * 12/1991 Sutton ..... 123/179.4
5,159,313 * 10/1992 Kawai et al. ..... 340/450.3
5,317,998 * 6/1994 Hanson et al. ..... 123/179.4

* cited by examiner

*Primary Examiner*—Andrew M. Dolinar
*Assistant Examiner*—Hai Huynh
(74) *Attorney, Agent, or Firm*—Carl A. Rowold; David G. Maire; Holland & Knight LLP

(57) ABSTRACT

A method and apparatus for restarting a locomotive engine based on the lubricating oil temperature $T_{oil}$ at the time of shutdown and an average oil cool down rate R. The average cool down rate R may be a function of the ambient air temperature $T_{AIR}$ at the time of shut down. The method and apparatus of this invention allows the engine to be shutdown during periods of inactivity to conserve fuel, but prevents the engine from cooling below a predetermined temperature in order to avoid excessive wear in operating limitations upon restart.

9 Claims, 2 Drawing Sheets

METHOD AND APPARATUS FOR OPERATING A LOCOMOTIVE ENGINE

This invention relates generally to the field of the operation of internal combustion engines, and more particularly to a method and apparatus for restarting an engine prior to it cooling beyond a predetermined temperature.

BACKGROUND OF THE INVENTION

It is well known that it can be difficult to start an internal combustion engine from a cold condition, particularly during cold weather conditions. When an engine is out of service, the engine lubricating oil will achieve a temperature consistent with the ambient air temperature, and it will become highly viscous. Upon starting the engine from the cold condition, the lubricating oil will gradually warm to its normal operating temperature. However, during the warm-up period, the operation of the lubricating system is degraded due to the high viscosity of the oil. Cold starting of an internal combustion engine is made more difficult due to the increased friction caused by the high oil viscosity, and engine parts may experience accelerated wear rates during the warm-up period due to the degraded lubricating system performance.

Self-propelled vehicles commonly utilize an internal combustion engine as a prime mover. The assignee of the present invention is a supplier of locomotives powered by turbo-charged diesel engines, such as the General Electric model GE7FDL16 diesel engine. Such engines are subject to the disadvantages discussed above during cold starting conditions. Furthermore, the operating instructions for a locomotive may include limitations on the engine throttle settings prior to the engine achieving full operating temperature. In cold weather conditions, there may be a delay of more than one hour after starting the locomotive engine from cold conditions until the engine is capable of operating at full throttle. U.S. Pat. No. 4,592,323 issued to Vest on Jun. 3, 1986, and assigned to the assignee of the present invention, discloses a system for limiting the maximum speed of the diesel engine of a locomotive when the lubricating oil is relatively cool and hence highly viscous. The Vest patent describes the design and operation of a diesel locomotive engine system in some detail and is incorporated by reference herein. For some applications, such as when operating in a switch yard, a locomotive is used for only short periods followed by periods of inactivity. In order to avoid delays in the availability of such engines, particularly in cold weather conditions, it is common for the engine of the locomotive to be placed in the idle position during periods of inactivity. Although this approach is effective in maintaining the engine at operating temperature, it also results In the wasting of fuel during the idling periods. Alternatively, the engine may be shut down between periods of operation in order to conserve fuel, however, this increases the risk the temperature of the lubricating oil will drop below the desired operating level.

FIG. 1 illustrates the lubricating oil system of a prior art diesel locomotive engine 10. An oil pump 12 draws oil from the engine 10 and delivers it to an oil cooler 14. The oil cooler 14 functions to transfer heat from the engine oil to a cooling water supply (not shown). The oil is then pumped through a filter 16 and returned to engine 10. For many applications, such as the GE7FDL16 diesel engine, the temperature of the oil is measured at a point in the lubricating oil system that is remote from the engine 10. As illustrated in FIG. 1, it is common for the temperature of the oil to be measured by a temperature sensor 18 located downstream of pump 12 near the inlet of cooler 14. Such a location is convenient for the design of the lubricating oil system, and it provides an accurate measurement of the lubricating oil temperature during the operation of the engine. However, during periods of engine shutdown, the oil becomes stagnate within the lubricating oil system and/or drains completely out of the filter 16 and cooler 14 and returns to the engine 10. Therefore, during engine shutdown conditions, temperature measuring device 18 is ineffective for providing an indication of the lubricating oil temperature within engine 10. Therefore, the operator of the locomotive will have no reliable indication of the actual lubricating oil temperature within engine 10 and will be unable to predict whether the operation of the engine 10 will be delayed upon startup due to lubricating oil temperature limitations. As a result, in order to assure that the locomotive will always be available for full power service, it is common practice to allow the engine to operate at idle conditions during periods of inactivity.

BRIEF SUMMARY OF THE INVENTION

Thus, there is a particular need for a method and apparatus for operating an engine in a manner that prevents cold starts and that improves the fuel efficiency of the engine. A method of operating a locomotive engine is provided comprising the steps of: obtaining an average cool down rate of the engine oil after shutdown of the engine; shutting down the engine; obtaining the oil temperature at the time of engine shutdown; calculating a maximum shutdown time for the engine by subtracting a predetermined minimum oil temperature from the oil temperature at the time of engine shutdown and dividing that difference by the average cool down rate; and restarting the engine before exceeding the maximum shutdown time. In addition, an apparatus for operating a locomotive engine is provided comprising: a means for storing an average engine cool down rate; a means for measuring the ambient temperature at the time of engine shutdown; a means for measuring the oil temperature at the time of engine shutdown; a controller connected to the means for storing, means for measuring the ambient temperature, and means for measuring the oil temperature, the controller comprising a means for calculating a maximum shutdown time as a function of the average oil cool down rate, the ambient temperature at the time of engine shutdown, and oil temperature at the time of engine shutdown; a means for measuring time elapsed after engine shutdown connected to the controller; and a means for starting the engine connected to the controller and operable to start the engine when the time elapsed after engine shutdown equals or exceeds the maximum shutdown time.

BRIEF DESCRIPTION OF THE DRAWINGS

The feature and advantages of the present invention will become apparent from the following detailed description of the invention when read with the accompanying drawings in which.

DETAILED DESCRIPTION OF THE INVENTION

In order to prevent the cold startup of an engine, it would be helpful to have available a measurement of the actual lubricating oil temperature within the engine. Unfortunately, many applications of large self-propelled traction vehicles such as locomotives do not include a temperature sensor in an appropriate location within the primary mover engine. While it is possible to add a temperature measuring device at an appropriate position within the engine, such additional instrumentation would be costly to install and would increase the maintenance cost for the vehicle. In lieu of adding such sensors to every vehicle, the inventor has developed a method of operation and apparatus for ensuring that the engine is restarted prior to cooling below a predetermined oil temperature limit.

In one embodiment of the present invention, the inventor has taken representative data from a GE7FDL16 diesel locomotive engine. The temperature of the lubricating oil $T_{OIL}$ was measured as a function of the time period after engine shutdown at a variety of different ambient air temperatures $T_{AIR}$. By obtaining a large and representative sampling of such data, as illustrated in step 20 in FIG. 2, the inventor was able to calculate an average rate of cool down R for the engine, as illustrated in step 22 of FIG. 2. Since the average cool down rate may change as a function of ambient air temperature, a plurality of cool down rates R may be calculated for a plurality of ambient air temperature ranges. For the GE7FDL16 engine, it was determined that when the temperature of the ambient air $T_{AIR}$ is greater than 39 degrees Fahrenheit and less than or equal to 55 degrees Fahrenheit, the cool down rate R is 0.15 degrees Fahrenheit/minute. For the same engine, the average cool down rate R when the ambient air temperature $T_{AIR}$ is greater than 55 degrees Fahrenheit but less than 110 degrees Fahrenheit is 0.10 degrees Fahrenheit/minute.

Figure 2:
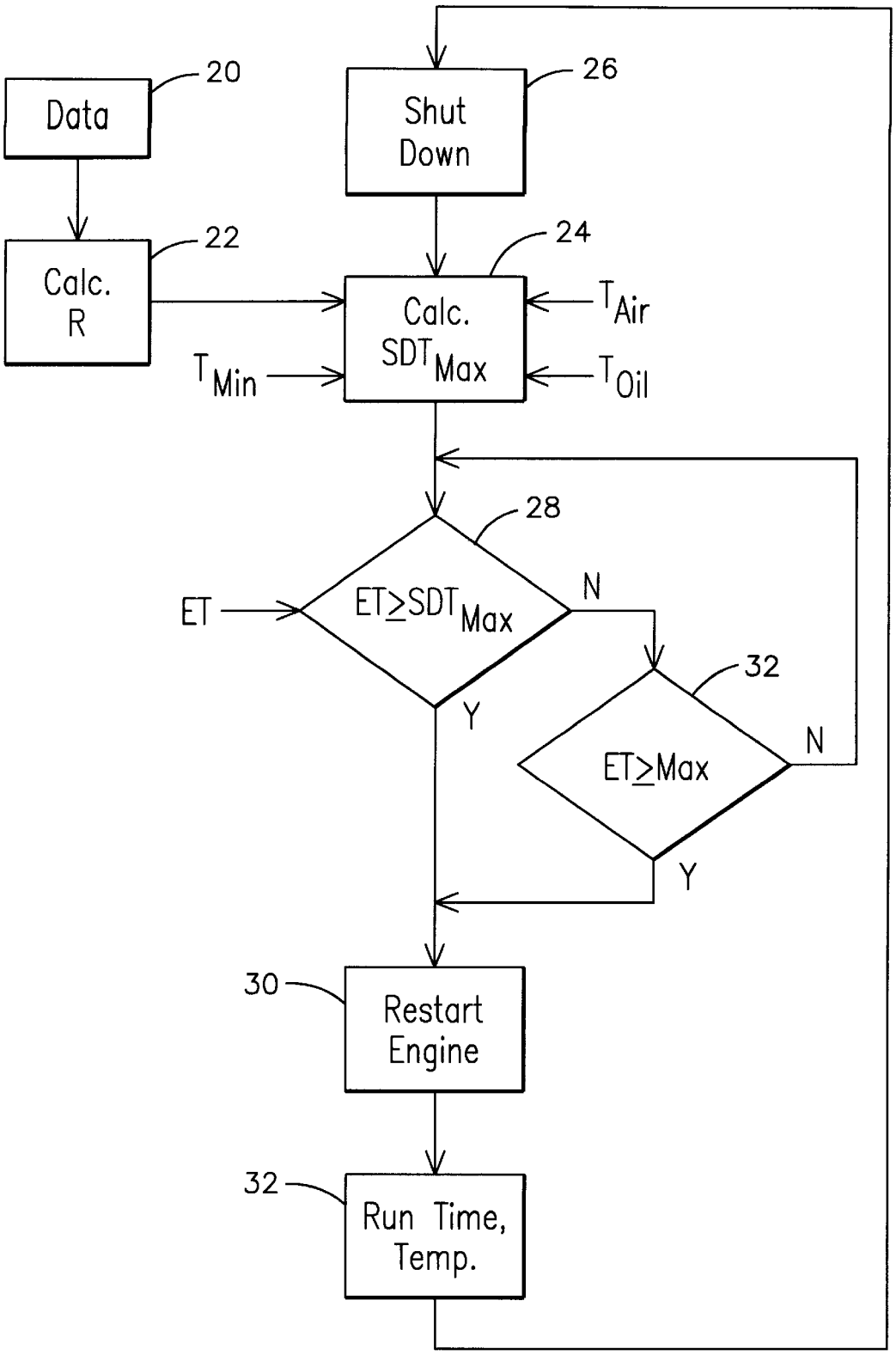
FIG. 2 is a flow chart illustrating a method of operating an engine wherein the engine is restarted within a calculated maximum shutdown time period.

Based upon the average cool down rate R, a maximum shutdown time period $SDT_{MAX}$ may be calculated, as in step 24 of FIG. 2. The maximum shutdown time $SDT_{MAX}$ is selected to prevent the lubricating oil temperature from dropping below a predetermined minimum temperature $T_{MIN}$ as may be defined by the engine designer. For the GE7FDL16 engine, the minimum lubricating oil temperature $T_{MIN}$ may be 140 degrees Fahrenheit. By subtracting the minimum lubricating oil temperature $T_{MIN}$ from the temperature of the oil $T_{OIL}$ at the time of shutdown, and dividing that difference by the average cool down rate R, the maximum shutdown time $SDT_{MAX}$ may be calculated in step 24.

When the engine is shutdown in step 26 of FIG. 2, a timer is activated to provide the elapsed time ET after engine shutdown. In step 28 of FIG. 2, the elapsed time ET is compared to the maximum shutdown time $SDT_{MAX}$. If the elapsed time ET equals or exceeds the maximum shutdown time $SDT_{MAX}$, a decision is made to restart the engine in step 30.

There may also exist an overall maximum shutdown period MAX defined by the engine designers. For example, it is desirable to limit the maximum shutdown period MAX for a GE7FDL16 engine to a period of four hours in order to maintain an adequate lubricating oil film on the engine bearings. If the elapsed time has not exceeded the calculated maximum shutdown time $SDT_{MAX}$ in step 28, there may be a further decision in step 32 wherein the elapsed time ET is compared to the predetermined maximum time MAX. If the elapsed time ET equals or exceeds the predetermined maximum value MAX, a decision is made to restart the engine in step 30.

After restart, the engine is then permitted to run for a defined period of time in order to increase the temperature of the lubricating oil, as illustrated in step 32 of FIG. 2. This time period may be a fixed period, or it may be a function of the ambient temperature $T_{AIR}$ or oil temperature Toil. After the defined running period, the engine may again be shut down as in step 26, and the entire process repeated as necessary to maintain the engine in a state of readiness.

The method illustrated in FIG. 2 will assure that the engine is not subjected to a cold starting condition, while allowing the engine to be shut down when not in use in order to minimize the fuel consumption. The particular values utilized for the cool down rate R may be empirically determined, calculated by computer modeling, or arbitrarily assigned based on operating experience. Similarly, the particular calculation performed to determine the maximum shutdown time $SDT_{MAX}$ in step 24 may take into account other variables or constants that are appropriate for a particular engine application. For example, the altitude or wind velocity may significantly affect the cool down rate R, or the probability of the need for further use of the engine may be considered when calculating the maximum shutdown time $SDT_{MAX}$.

Figure 1:
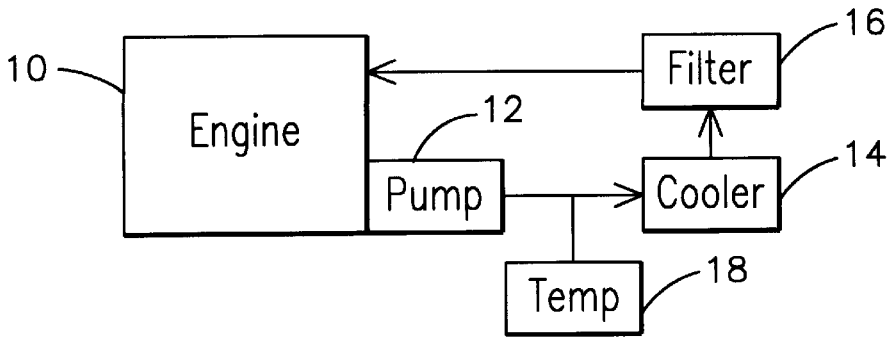
FIG. 1 PRIOR ART
FIG. 1 is a schematic illustration of a prior art internal combustion engine lubricating oil system.
Figure 3:
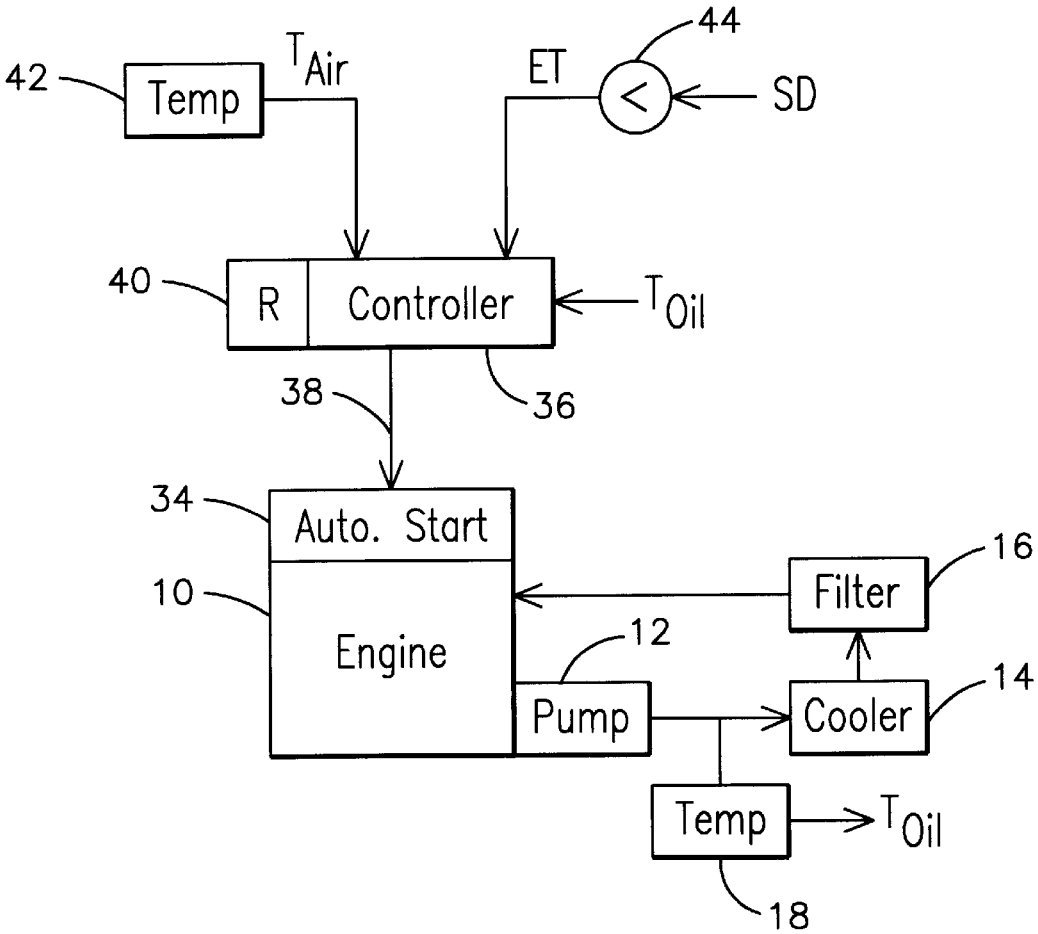
FIG. 3 is a schematic illustration of an engine and lubricating oil system used for implementing the method of FIG. 2.

FIG. 3 illustrates an apparatus for implementing the method of FIG. 2. Components in FIG. 3 that are similar to those in the prior art device of FIG. 1 are consistently numbered between the two figures. Specifically, an engine 10 having a lubricating oil system including a pump 12, cooler 14, filter 16, and temperature measuring instrument 18 are included in the apparatus of FIG. 3. A means 34 for automatically starting the engine 10 is provided to accomplish the restart of the engine 10 in step 30 of FIG. 2. Such means 34 for starting the engine may include components that provide a similar function for other purposes as may be available on prior art engines. For example, the engine starter, fuel injection system and governor may be part of the means 34 for starting the engine. A controller 36 is provided having an output signal 38 for activating the means 34 for starting the engine. The controller has as inputs signals for the oil temperature $T_{OIL}$, elapsed time ET after engine shutdown, and ambient air temperature $T_{AIR}$. In addition, the controller 36 is attached to a means 40 for storing an average engine lubricating cool down rate R. Thus, the controller 36 has available the necessary inputs for performing the steps of calculating the maximum shutdown time $SDT_{MAX}$ and for comparing that shutdown time to the elapsed time ET, as illustrated in steps 24, 28 of FIG. 2. Controller 36 may also perform the function of step 32 of comparing the elapsed time ET to a predetermined maximum value MAX, as illustrated in step 32 of FIG. 2. Should the decision of step 28 or 32 be favorable for restarting the engine 10, a signal 38 is passed to the means 34 for starting the engine to accomplish step 30 of FIG. 2. Controller 36 may also perform the decisional steps necessary to determine the run time of the engine 10 as illustrated in step 32 of FIG. 2.

Controller 36 may be embodied as any hardware, software, and/or firmware device as may be known in the art. For example, most modern locomotives contain a centralized computer control system that may be modified to include the functions described herein. The means 40 for storing the cool down rate R may be a memory function in a solid state electronic device or may be a programmed value in software or firmware. The functions of controller 36 may be performed manually by an operator, however, a preferred embodiment would permit the unattended operation of such a system. Other components of the apparatus of FIG. 2 are available as standard items, such as an air temperature measurement instrument 42 and the timing device 44 operable to generate the elapsed time ET signal in response to a shutdown signal SD.

While the preferred embodiment of the present invention has been shown and described herein, it will be obvious that such embodiments are provided by way of example only. Numerous variations, changes and substitutions will occur to those of skill in the art without departing from the invention herein. Accordingly, it is intended that the invention be limited only by the spirit and scope of the appended claims.

What is claimed is:

1. A method of operating a locomotive engine comprising the steps of:

obtaining an average cool down rate of the engine oil after shutdown of the engine;

shutting down the engine;

obtaining the oil temperature at the time of engine shutdown;

calculating a maximum shutdown time for the engine by subtracting a predetermined minimum oil temperature from the oil temperature at the time of engine shutdown and dividing that difference by the average cool down rate; and restarting the engine before exceeding the maximum shutdown time.

2. The method of claim 1, wherein the step of obtaining the average cool down rate comprises obtaining an average cool down rate for each of at least two ambient temperature ranges;

obtaining the ambient temperature at the time of engine shutdown; and wherein the step of calculating comprises calculating a maximum shutdown time for the engine by subtracting a predetermined minimum oil temperature from the oil temperature at the time of engine shutdown and dividing that difference by the average cool down rate for the ambient temperature range that includes the ambient temperature at the time of engine shutdown.

3. The method of claim 1, further comprising the steps of:

providing an engine controller;

programming the controller with the average cool down rate;

providing a signal to the controller corresponding to the oil temperature at the time of engine shutdown;

using the controller to perform the step of calculating.

4. The method of claim 3, further comprising the steps of:

connecting an apparatus for automatically starting the engine to the controller;

wherein the step of restarting the engine comprises programming the controller to activate the apparatus for automatically starting the engine.

5. The method of claim 1, wherein the step of calculating further comprises limiting the maximum shutdown time to a predetermined maximum value.

6. The method of claim 1, further comprising the step of shutting down the engine after the step of restarting the engine when the oil temperature has warmed to a predetermined temperature.

7. The method of claim 1, further comprising the step of shutting down the engine a predetermined time period after the step of restarting the engine.

8. An apparatus for operating a locomotive engine, the apparatus comprising:

a means for storing an average engine oil cool down rate;

a means for measuring the ambient temperature at the time of engine shutdown;

a means for measuring the oil temperature at the time of engine shutdown;

a controller connected to the means for storing, means for measuring the ambient temperature, and means for measuring the oil temperature, the controller comprising a means for calculating a maximum shutdown time as a function of the average oil cool down rate, the ambient temperature at the time of engine shutdown, and oil temperature at the time of engine shutdown;

a means for measuring time elapsed after engine shutdown connected to the controller; and a means for starting the engine connected to the controller and operable to start the engine when the time elapsed after engine shutdown equals or exceeds the maximum shutdown time.

9. The apparatus of claim 8, wherein the controller further comprises a means for limiting the maximum shutdown time to no more than a predetermined maximum value.

* * * * *